US006158351A

United States Patent [19]

Mravic et al.

[11] Patent Number: 6,158,351

[45] **Date of Patent: *Dec. 12, 2000**

[54] FERROMAGNETIC BULLET

[75] Inventors: Brian Mravic, North Branford, Conn.; Henry J. Halverson, Collinsville, Ill.; Deepak Mahulikar, Madison, Conn.

[73] Assignee: Olin Corporation, East Alton, Ill.

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/681,138

[22] Filed: Jul. 22, 1996

Related U.S. Application Data

[63] Continuation of application No. 08/324,304, Oct. 17, 1994, abandoned, which is a continuation-in-part of application No. 08/125,946, Sep. 23, 1993, Pat. No. 5,399,187.

[51] Int. Cl.[7] ..... F42B 1/00; F42B 8/14

[52] U.S. Cl. ..... 102/517; 102/501; 102/514; 102/515; 75/246

[58] Field of Search ..... 102/501, 507, 102/514, 515, 517; 75/246

[56] References Cited

U.S. PATENT DOCUMENTS

| | | | |
|---|---|---|---|
| H1235 | 10/1993 | Canaday | 102/334 |
| 2,105,526 | 1/1938 | Foisy | 102/26 |
| 2,409,307 | 10/1946 | Patch et al. | 102/92.5 |
| 2,442,155 | 5/1948 | Weese | 102/92.5 |
| 2,995,090 | 8/1961 | Daubenspeck | 102/91 |
| 3,123,003 | 3/1964 | Lange, Jr. et al. | 102/91 |
| 3,363,561 | 1/1968 | Irons | 102/42 |
| 3,898,933 | 8/1975 | Castera et al. | 102/92.7 |
| 3,946,673 | 3/1976 | Hayes | 102/52 |
| 4,005,660 | 2/1977 | Pichard | 102/92.1 |
| 4,027,594 | 6/1977 | Olin et al. | 102/92.4 |
| 4,428,295 | 1/1984 | Urs | 102/448 |
| 4,603,637 | 8/1986 | Snide et al. | 102/529 |
| 4,625,650 | 12/1986 | Bilsbury | 102/516 |
| 4,643,099 | 2/1987 | Zuther et al. | 102/517 |
| 4,850,278 | 7/1989 | Dinkha et al. | 102/501 |
| 4,881,465 | 11/1989 | Hooper et al. | 102/501 |
| 4,939,996 | 7/1990 | Dinkha et al. | 102/501 |
| 4,949,644 | 8/1990 | Brown | 102/498 |
| 4,949,645 | 8/1990 | Hayward et al. | 102/517 |
| 4,958,572 | 9/1990 | Martel | 102/529 |
| 5,069,869 | 12/1991 | Nicolas et al. | 419/28 |
| 5,088,415 | 2/1992 | Huffman et al. | 102/515 |
| 5,264,022 | 11/1993 | Haygarth et al. | 75/255 |
| 5,399,187 | 3/1995 | Mravic et al. | 75/228 |

FOREIGN PATENT DOCUMENTS

| | | |
|---|---|---|
| 554538 | 6/1932 | Germany . |
| 578815 | 6/1933 | Germany . |
| 423550 | 9/1963 | Switzerland . |
| 2200976 | 11/1984 | United Kingdom . |

OTHER PUBLICATIONS

Mary–Jacque Mann et al. Shot Pellets:An Overview AFTE Journal (vol. 26, No. 3) (Jul. 1994).

"The Production of Metal Powders by Atomization" by John Keith Beddow Heyden & Son Ltd. (1978) Beddow. pp. 3–6.

*Primary Examiner*—Daniel J. Jenkins
*Attorney, Agent, or Firm*—Gregory S. Rosenblatt; Wiggin & Dana

[57] ABSTRACT

A lead free ferromagnetic article is disclosed. The article is a compacted composite having a heavy more dense constituent that is preferably ferrotungsten and a less dense second constituent that is either a metal alloy or a polymer. The ferromagnetic constituent is present in an amount sufficient to impart the article with ferromagnetism. The ferromagnetic property allows fragments of the article, such as a projectile, bullet or shaped charge liner to be separated from dirt or other environments.

6 Claims, 5 Drawing Sheets

FERROMAGNETIC BULLET

CROSS-REFERENCE TO RELATED APPLICATIONS

This application is a continuation of U.S. patent application Ser. No. 08/324,304 filed Oct. 17, 1994 now abandoned which is a continuation in part of U.S. patent appplication Ser. No. 08/125,946 by Mravic et al, filed Sep. 23, 1993 that is now U.S. Pat. No. 5,399,187.

BACKGROUND OF THE INVENTION

This invention relates generally to projectiles and more particularly to a lead free, ferromagnetic projectile.

DESCRIPTION OF THE RELATED ART

Lead projectiles and lead shot expended at shooting ranges pose a significant environmental hazard. Disposal of the lead contaminated sand used as a backstop in indoor ranges is expensive, since lead is a hazardous material. Due to the low value of lead metal, reclamation of the lead from the sand is not economically feasible for most target ranges. At outdoor ranges, the lead must be removed before the range land can be used for other purposes. Frequently, the entire top soil layer is removed and disposed elsewhere, a time consuming and costly operation.

Accordingly, there exists a need for an effective lead free bullet that is easily separated from range soil and sand.

Density differences between bullets of the same size result in differences in long range trajectory and differences in firearm recoil. Such differences are undesirable. The shooter needs to have a consistent trajectory and a recoil so the "feel" of shooting a lead free practice round should be similar to that of shooting a lead service round. If there are differences in trajectory and recoil, experience gained on the practice range will degrade, rather than improve, accuracy when firing a lead bullet in the field.

Various approaches have been used to produce shot pellets that are non toxic. U.S. Pat. Nos. 4,027,594 and 4,428,295 assigned to the assignee of the present invention, disclose pellets made of one or more metal powders where one of the powders is lead.

U.S. Pat. Nos. 2,995,090 and 3,193,003 disclose frangible gallery bullets made of iron powder, a small amount of lead powder, and a thermoset resin. While substantially lead free, a drawback of these bullets is a density significantly less than that of a lead bullet.

U.S. Pat. No. 4,881,465 discloses a shot pellet made of lead and ferrotungsten, while U.S. Pat. Nos. 4,850,278 and 4,939,996 disclose a projectile made of ceramic zirconium. U.S. Pat. No. 4,005,660 discloses a polyethylene matrix which is filled with a metal powder such as bismuth, tantalum, nickel, and copper. Yet another frangible projectile is made of a polymeric material which is filled with metal or metal oxide.

U.S. Pat. No. 4,949,644 discloses shot made of bismuth or a bismuth alloy. However, bismuth is in short supply and considerably more expensive than lead.

U.S. Pat. No. 5,088,415 discloses a plastic covered lead shot. However, this shot material still contains lead, which upon backstop impact, will be exposed to the environment. Plated lead bullets and plastic coated lead bullets are also in use, but they have the same drawback, on target impact the lead is exposed creating difficulty in disposing of spent bullets.

None of the prior bullets noted above has proved commercially viable, either due to cost, density differences, difficulty of mass production or difficulty of disposal. Accordingly, there remains a need for a projectile for target shooting ranges or for hunting use which is substantially lead free, performs ballistically similar to lead and facilitates reclamation of target backstops and range soil.

SUMMARY OF THE INVENTION

Accordingly, it is an object of the invention to provide a projectile that is substantially lead free. A second object of the invention is for the projectile to have ballistic performance similar to lead. A third object of the invention is for the projectile to be easily removed from the shooting range soils and backstops.

It is a feature of the invention that the projectile is a sintered composite having one or more, high density constituents selected from the group consisting of tungsten carbide, tungsten, ferrotungsten, cemented tungsten carbide alloys and carboloy (a tungsten carbide-cobalt sintered alloy, typically containing from 3% to 13% by weight cobalt), and a second, lower density constituent selected to be a metallic matrix material such as tin, zinc, iron, nickel, cobalt and copper. Alternatively, the second constituent is a plastic matrix material such as a phenolic, epoxy, dialkylphthalate, acrylic, polystyrene, polyethylene, or polyurethane. It is another feature of the invention that an effective amount, typically more than 50% by weight, of the projectile constituents are ferromagnetic. In addition, the composite projectile may contain a filler metal such as iron powder or zinc powder. The bullet of the invention comprises a solid body having a density of at least about 9 grams per cubic centimeter (80 percent that of pure lead) and a yield strength in compression greater than about 4500 psi.

Other constituents may be added in small amounts for special purposes such as enhancing frangibility. If iron is one constituent, the addition of carbon results in a brittle microstructure after a suitable heat treatment. Lubricants or solvents can be added to enhance powder flow properties, compaction properties and ease die release.

It is an advantage of the invention that ferrotungsten is ferromagnetic and has a density greater than that of lead. A ferrotungsten containing composite is economically feasible for projectiles and, by metallurgical and ballistic analysis, can be alloyed in proper amounts under proper conditions to become useful for a lead free bullet.

The invention further stems from the realization that ballistic performance can best be measured by actual shooting experiences since the extremes of acceleration, pressure, temperature, frictional forces, centrifugal acceleration and deceleration forces, impact forces both axially and laterally, and performance against barriers typical of bullet stops in current usage impose an extremely complex set of requirements on a bullet that make accurate theoretical prediction virtually impossible.

DETAILED DESCRIPTION OF THE INVENTION

Figure 1:
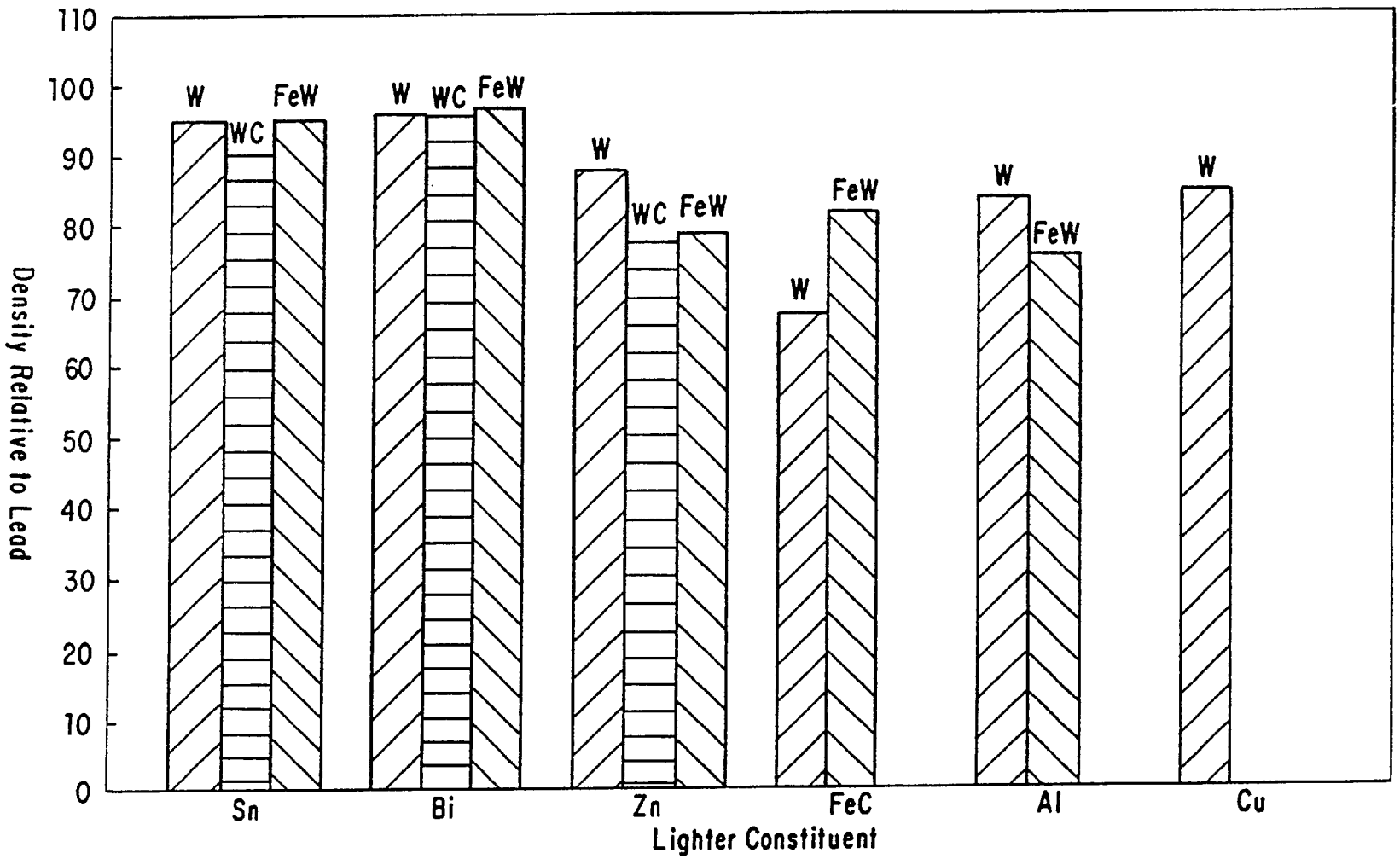
FIG. 1 is a bar graph of densities of powder composites.

There are at least six requirements for a successful lead free bullet. First, the bullet must closely approximate the recoil of a lead bullet when fired so that the shooter feels as though he is firing a standard lead bullet. Second, the bullet must closely approximate the trajectory, i.e. exterior ballistics, of a lead bullet of the same caliber and weight so that the practice shooting is directly relevant to shooting in the field with an actual lead bullet. Third, the bullet must not penetrate or damage the normal steel plate backstop on the target range and must not ricochet significantly. Fourth, the bullet must remain intact during its travel through the gun barrel and while in flight. Fifth, the bullet must not damage the gun barrel. Sixth, the cost of the bullet must be reasonably comparable to other alternatives.

In order to meet the first two requirements, the lead free bullet must have approximately the same density as lead. This means that the bullet must have an overall density of at least 80% that of lead or 9 grams per cubic centimeter.

The third requirement, not penetrating or damaging the steel backstops at target shooting ranges, dictates that the bullet must either (1) deform at stresses lower than that sufficient to penetrate or severely damage the backstop, (2) fracture into small pieces at low stresses or (3) both deform and fracture at low stress.

As an example, a typical 158 grain lead (0.0226 lb.) 0.38 Special bullet has a muzzle kinetic energy from a four inch barrel of 200 foot pounds (2,400 inch pounds) and a density of 0.41 pounds per cubic inch. This corresponds to an energy density of 43,600 inch pounds per cubic inch. The deformable lead free bullet in accordance with the invention must absorb enough of this energy per unit volume as strain energy (elastic plus plastic) without imposing on the backstop stresses higher than the yield strength of mild steel (about 45,000 psi) in order for the bullet to stop without penetrating or severely damaging the target backstop. In the case of a frangible bullet or a deformable frangible bullet, respectively, the fracture stress of the bullet must be below the stresses experienced by the bullet upon impact with the target backstop and below the yield strength of mild steel.

The requirements that the bullet remain intact as it passes through the barrel and that the bullet not cause excessive barrel erosion are more difficult to quantify. Actual shooting tests are normally required to determine this quality. However, if needed, the bullet of the invention may be coated with metal or plastic or jacketed in a conventional manner to protect the barrel.

The requirement that the projectile be reclaimable from shooting range environments such as sand traps and top soil is best satisfied by including in the projectile a ferromagnetic constituent. Ferromagnetic materials are those metals, alloys and compounds of the transition (iron group), rare-earth and actinide elements that, below the Curie temperature, have atomic magnet moments tending to line up in a common direction. These materials are characterized by a strong attraction to other magnetized materials.

The weight percent of the ferromagnetic component is at least that effective to impart the sintered fragments of a spent projectile with ferromagnetic capability. The particles are then separated from the sand or other environment using magnetic separation techniques.

The reclaimed projectile fragments can be further processed to separate the ferromagnetic constituent from the projectile matrix and any coating or jacket. For example, separation may include mechanical crushing or grinding, or for polymer matrix, burning or chemically dissolving the matrix.

Suitable ferromagnetic constituents for the high density first component include ferrotungsten and cemented tungsten carbide alloys having a ferromagnetic addition. Ferrotungsten is generally understood to be a tungsten base alloy that includes iron having a tungsten content by weight of from about 70% to about 85%. Preferably, the carbon content of the ferrotungsten is less than about 0.6%. In this patent application, any tungsten base alloy containing iron that exhibits ferromagnetism is included.

In the projectile, the ferrotungsten is present in a weight percent above about 50% and preferably from about 70% to 90% is preferred.

When the second constituent of the projectile is to provide the ferromagnetism, suitable ferromagnetic constituents for the lower density second component include iron, nickel and cobalt. Iron is most preferred due to its low cost. Preferably, the iron is present in an amount of from about 10% to about 30% by weight.

The metal matrix bullets in accordance with the preferred embodiments of the present invention are fabricated by powder metallurgical techniques. For the more frangible materials, the powders of the individual constituents are blended, compacted under pressure to near net shape, and sintered. If the bullets are jacketed, compacting and sintering can be done in the jacket or the bullets could be compacted and sintered before insertion into the jackets. If the bullets are coated, they would be coated after compacting and sintering.

The proportions of the several powders required for a desired density is different than that calculated by the rule of mixtures because of the inability to eliminate all porosity. Porosity is compensated for by an appropriate increase in the amount of the higher density constituent, typically tungsten, ferrotungsten, carboloy, tungsten carbide or mixtures thereof. The optimum mixture is determined by the tradeoff between raw material cost and bullet performance.

For the more ductile matrix materials such as the metals mentioned above, the bullets may be made by the above process or alternatively, compacted into rod or billet shapes using conventional pressing or isostatic pressing techniques. After sintering, the rod or billet could then be extruded into wire for fabrication into bullets by forging using punches and dies as is done with conventional lead bullets. Alternatively, if the materials are too brittle for such fabrication, conventional fabrication processes could be used to finish the bullet.

The frangibility of the composite bullet can be enhanced through various processing steps. An optional heat treatment to embrittle the matrix enhances frangibility after final shape forming. For example, an iron matrix bullet having a carbon addition could be embrittled by suitable heat treatment.

A tin matrix bullet could be embrittled by controlled tempering at a temperature where partial transformation to alpha tin occurs. Typically, this temperature is from about 375° C. to about 575° C. This method can provide precise control of the degree of frangibility.

A third method to enhance embrittlement is by selecting impurity additions such as bismuth in a copper matrix composite. After fabrication, the bullet may be heated to a temperature range where the impurity collects preferentially at grain boundaries.

In addition, even without embrittling additives, frangibility can be controlled by suitably varying the sintering time and/or sintering temperature.

When the composite projectile has a thermoplastic or thermosetting plastic matrix, the metallic powders and polymer powders are blended as described considering mass and density requirements. The mixture is then formed into the final part by any conventional process used in of polymer technology such as injection molding, transfer molding.

In the case of jacketed plastic matrix bullets, compacting under heat can be done with the composite powder inside the jacket. Alternatively, the powders can be compacted using pressure and heat to form pellets for use in such processes.

To protect the gun barrel from damage during firing, the composite bullets of the invention are preferably jacketed or coated with a soft metallic or plastic coating. The coatings is preferably tin, zinc, copper, brass or plastic. One suitable ferromagnetic jacket material is iron.

For plastic matrix bullets, plastic coatings are preferred. In a most preferred embodiment, the plastic matrix and the coating are the same polymer.

Plastic coatings may be applied by dipping, spraying, fluidized bed or other conventional plastic coating processes. The metallic coatings may be applied by electroplating, hot dipping or other conventional coating processes.

The benefits of the composite bullets of the invention will become more apparent from the Examples that follow.

EXAMPLES

A. Plastic Matrix

Frangible plastic matrix composite bullets were made of tungsten powder with an average particle size of 6 microns. Iron powder was added to the tungsten powder at levels of 0, 15, and 30 percent by weight. After blending with one of two polymer powders, phenyl formaldehyde (Lucite) or polymethylmethacrylate (Bakelite) which acted as the matrix, the mixtures were hot compacted at a temperature within the range of from about 300° F. to about 350° F. and a pressure of about 35–40 ksi into 1.25 inch diameter cylinders which were then cut into rectangular parallelepipeds for compression testing and drop weight testing.

Six (6) samples were made: (#1) Lucite—Tungsten; (#2) Lucite—85% Tungsten—15% Iron; (#3) Lucite—70% Tungsten—30% Iron; (#4) Bakelite—Tungsten; (#5) Bakelite—85% Tungsten—15% Iron; (#6) Bakelite—70% Tungsten—30% Iron. The bullet materials so formed were very frangible in the compression test. Their behavior in the drop weight test was similarly highly frangible. The densities relative to that of lead for these samples (#1) 81%; (#2) 78%; (#3) 75%; (#4) 84%; (#5) 80%; (#6) 78%. The maximum stress in the compression test was (in ksi) (#1) 4.3; (#2) 3.4; (#3) 2.7; (#4) 4.7; (#5) 1.4; (#6) 1.9. The energy absorbed in the compression test for these materials was (in inch-pounds per $in^3$) (#1) 49; (#2) 40; (#3) 21; (#4) 40; (#5) 10; (#6) 9. The maximum stress before fracture was below 5 ksi which is well within the desired range to avoid backstop damage.

Metal Matrix Composites

FIG. 1 shows the densities attained with metal matrix composites made of tungsten powder, tungsten carbide powder or ferrotungsten powder blended with powder of either tin, bismuth, zinc, iron (with 3% carbon), aluminum, or copper. The proportions were such that they would have the density of lead if there was no porosity after sintering. The powders were cold compacted into half-inch diameter cylinders using pressures of 100 ksi. They were then sintered for two hours at appropriate temperatures, having been sealed in stainless steel bags. The sintering temperatures were (in degrees Celsius) 180, 251, 350, 900, 565, 900 respectively.

Figure 2:
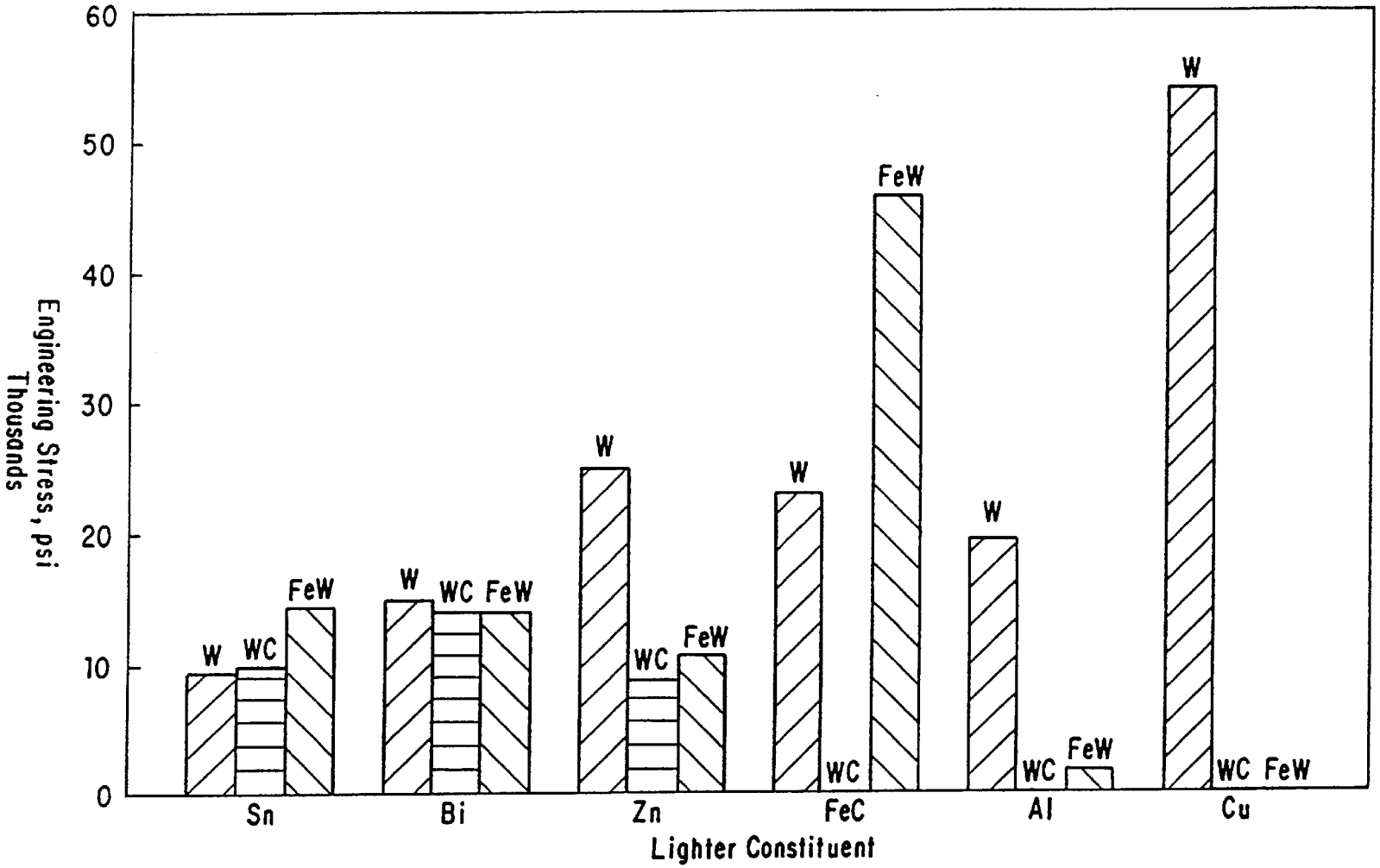
FIG. 2 is a bar graph of the maximum engineering stress attained under compression with the powder composites.
Figure 3:
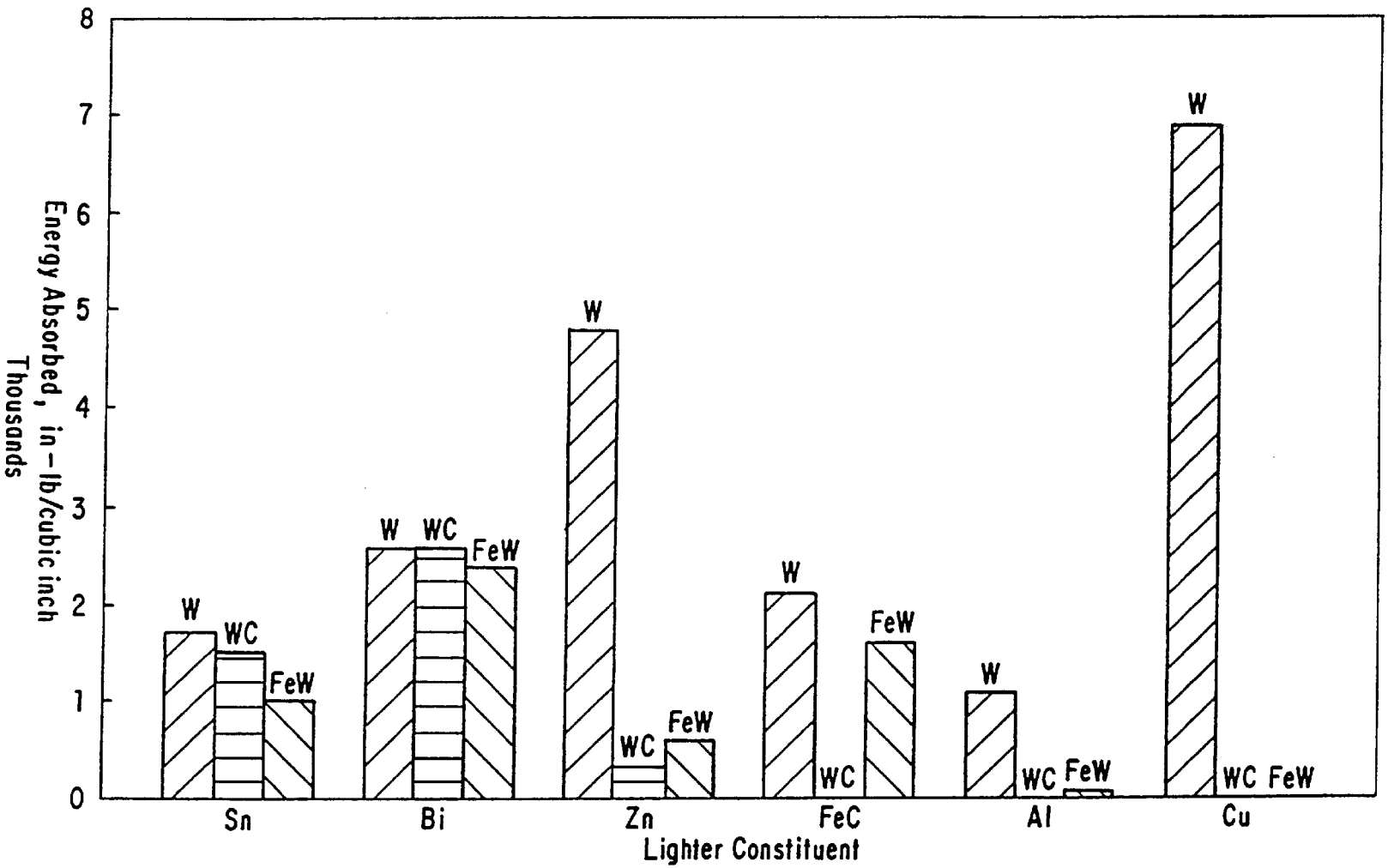
FIG. 3 is a bar graph of the total energy absorbed during compressive deformation to 20% strain or fracture.

FIG. 2 shows the maximum axial internal stresses attained in the compression test. FIG. 3 shows the energies absorbed up to 20 percent total strain (except for the copper tungsten compact which reached such high internal stresses that the test was stopped before 20 percent strain was achieved). All of the materials exhibited some plastic deformation. The energy absorptions in the compression test indicate the relative ductilities, with the more energy absorbing materials being the most ductile.

Even the most ductile samples such as the tin and bismuth matrix composites showed some fracturing during the compression test due to barreling and secondary tensile stresses which result from this. In the drop weight test using either 240 foot pounds or 120 foot pounds, the behavior was similar to but an exaggeration of that observed in the compression test.

Control Examples

Figure 4:
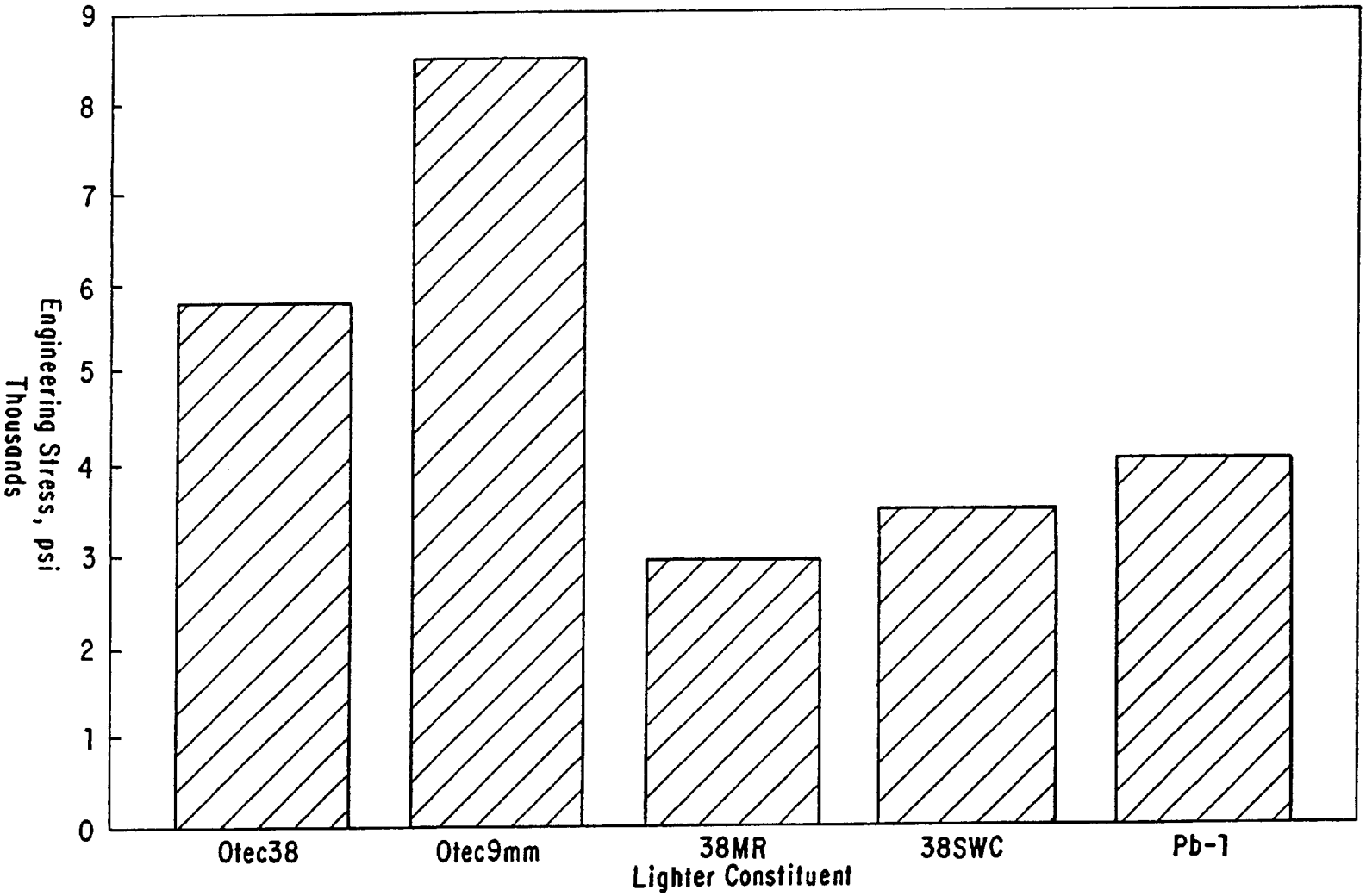
FIG. 4 is a bar graph showing the maximum stress at 20% compressive deformation.
Figure 5:
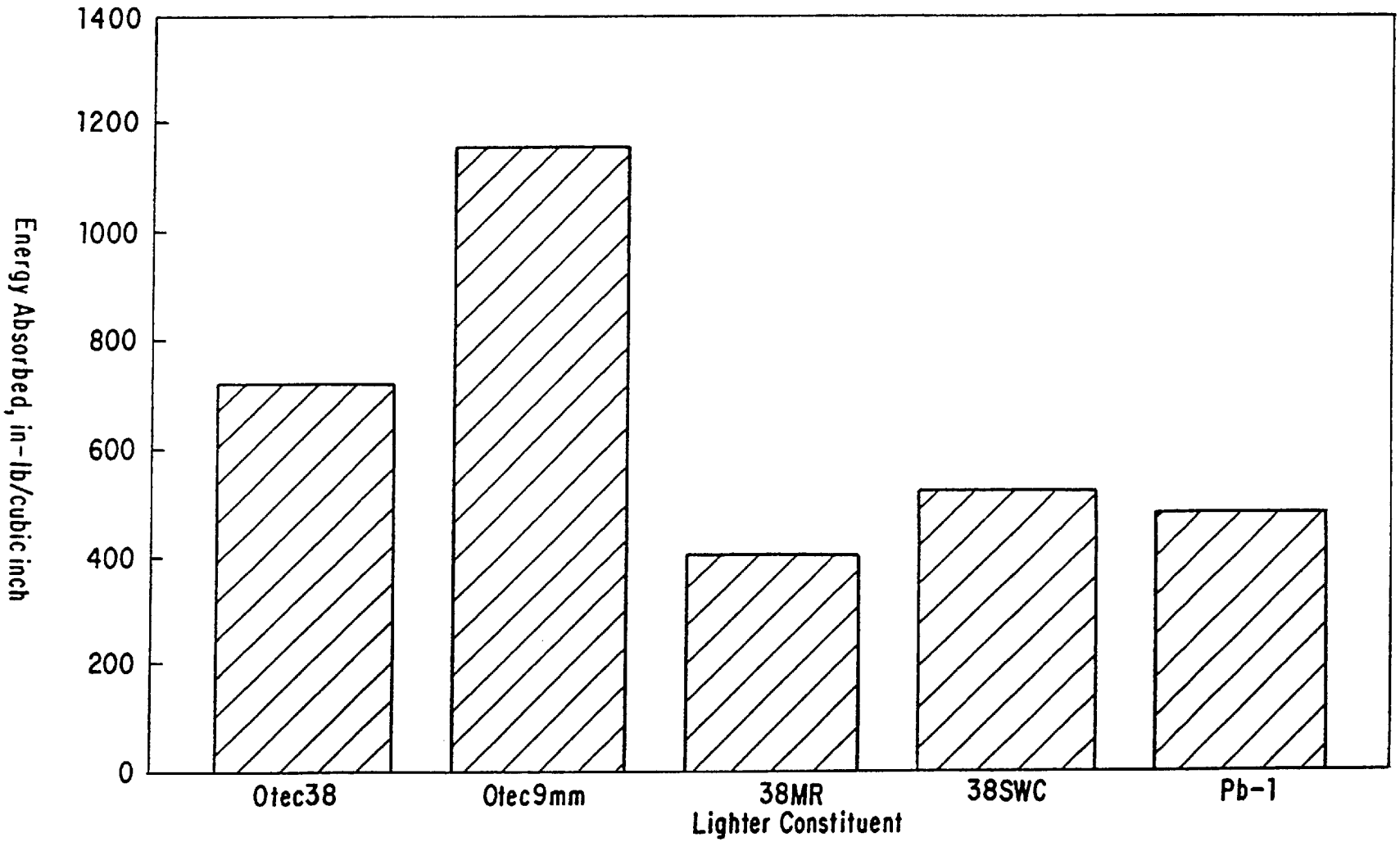
FIG. 5 is a bar graph showing the total energy absorbed in 20% compressive deformation or fracture of the bullets of FIG. 4.

FIG. 4 shows, for comparison, a lead slug, two standard 38 caliber bullets, and two commercial plastic matrix composite bullets tested in compression. FIG. 4 shows that maximum stresses of the lead slug and lead bullets were significantly less than those of the plastic bullets. However, all were of the same order as those attained by the metal matrix samples in the iron free plastic matrix samples. FIG. 5 shows the energy absorption for these materials. Values are generally less than that of the metal matrix samples shown in FIG. 3 and much higher than that of the frangible plastic matrix samples.

All of these materials deformed significantly in the 240 ft.-lb. drop weight test. The lead samples did not fracture, whereas the plastic matrix bullets did.

Jacketed Composite Bullets

As another example, 38 caliber metal-matrix bullets and plastic-matrix bullets with the compositions listed in Table I were fabricated inside standard brass jackets (deep-drawn cups) which had a wall thickness varying from 0.010 inches to 0.025 inches. The plastic-matrix ("Lucite" or "Bakelite" listed as code 1 and code 2 in the Table) samples were compacted at the temperature described in the first example. The metal-matrix samples (Codes 3–11) were compacted at room temperature and sintered as described above while they were encased in the jackets.

These bullets were fired into a box of sawdust using a +P load of powder, exposing them to pressures in excess of 20,000 pounds per square inch while in the barrel. Examination and weighing of the samples before and after firing revealed that the iron-matrix, copper-matrix and zinc-matrix bullets lost no weight and no material from the end of the composite core that had been exposed to the hot gases in the barrel. Microstructural examination revealed that only the pure bismuth bullet had internal cracks after being fired.

These bullets were also fired at a standard steel plate backstop (0.2 inches thick, hardness of Brinell 327) at an incidence angle of 45 degrees and a distance typical of indoor pistol ranges. None of the bullets damaged the backstop or ricocheted.

While the invention has been described in terms of frangible projectiles, the ferromagnetic materials of the invention also can find utility in articles used to direct an explosive charge such as shaped charge liners and cones in oil well fields.

The patents and patent applications cited herein are incorporated by reference in their entirety as if they were set forth at length.

While the invention has been described with reference to preferred embodiments and specific examples, it is apparent that many changes, modifications and variations can be made without departing from the inventive concept disclosed herein. Accordingly, the spirit and broad scope of the appended claims is intended to embrace all such changes, modifications and variations that may occur to one of skill in the art upon a reading of the disclosure.

What is claimed is:

1. A lead-free projectile comprising a sintered compacted composite consisting essentially of:

(a) at least 50% by weight ferrotungsten, and (b) a second constituent present in an amount of from 10% to 30% by weight and selected from the group consisting of iron, nickel, and cobalt;

wherein the projectile has a density of at least 9 grams per cubic centimeter and is sufficiently ferromagnetic to be separated from its environment by magnetic separation techniques.

2. The lead-free projectile of claim 1 wherein the second constituent is iron.

3. The lead-free projectile of claim 2 wherein said compacted composite contains from about 70% to about 90% by weight ferrotungsten and the balance is iron.

4. The-lead free projectile of claim 1 coated with a jacket selected from the group consisting of tin, zinc, copper, brass and plastic.

5. The lead-free projectile of claim 1 wherein the projectile has a yield strength in compression greater than about 4500 psi.

6. The lead-free projectile of claim 1 wherein the compacted composite is sintered.

* * * * *